United States Patent [19]

Kenkelen

[11] 4,019,277

[45] Apr. 26, 1977

[54] COMBINED FAN AND NOISEMAKER

[75] Inventor: Charles W. Kenkelen, Philadelphia, Pa.

[73] Assignee: Melvin G. Rabin, El Paso, Tex.

[22] Filed: Jan. 12, 1976

[21] Appl. No.: 648,592

[52] U.S. Cl. ..... 46/175 R; 46/191

[51] Int. Cl.[2] ..... A63H 5/00

[58] Field of Search ..... 46/1 R, 175 R, 191

[56] References Cited

UNITED STATES PATENTS

| | | | |
|---|---|---|---|
| 1,478,399 | 12/1923 | Rothschild | 46/175 R |
| 3,019,553 | 2/1962 | Gomez et al. | 46/191 |
| 3,059,375 | 10/1962 | Tischer | 46/191 |
| 3,157,000 | 11/1964 | Stavig | 46/191 |

*Primary Examiner*—Louis G. Mancene
*Assistant Examiner*—Robert F. Cutting
*Attorney, Agent, or Firm*—Seidel, Gonda & Goldhammer

[57] ABSTRACT

A combined fan and noisemaker including a central anvil blade and juxtaposed outer blades, protuberances on the outer blade for percussively engaging the anvil blade, and means for pivotably securing together the outer and anvil blades whereby the outer blades may be pivoted to an open fan-like disposition or may be aligned in juxtaposed relationship so that said outer blades may be percussively struck on said anvil blade.

3 Claims. 2 Drawing Figures

COMBINED FAN AND NOISEMAKER

The present invention is directed to a combined fan and noisemaker, and more particularly to a combined fan and noisemaker which may be used at athletic events and the like.

A wide variety of noisemaking paddles have been heretofore developed, such as the noisemaking paddles disclosed in U.S. Pat. No. 3,059,375 issued Oct. 23, 1962, and U.S. Pat. No. 3,157,000 issued Nov. 17, 1974. Moreover, the use of multibladed fans has long been known, and is disclosed in patents such as U.S. Pat. No. 1,310,039 of July 15, 1919, and U.S. Pat. No. 1,630,397 of May 31, 1927.

However, there has not heretofore been developed a simple combined fan and noisemaker of low cost, durable construction, and which is capable of being utilized both as a fan and as a noisemaker without requiring any degree of digital dexterity.

This invention has as an object the provision of a novel combined fan and noisemaker.

This invention has as another object the provision of a combined fan and noisemaker which may be readily assembled from lowcost materials and which is capable of performing both as a fan and noisemaker without the exercise of training or skill.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawings, wherein like reference parts refer to like elements:

Figure 1:
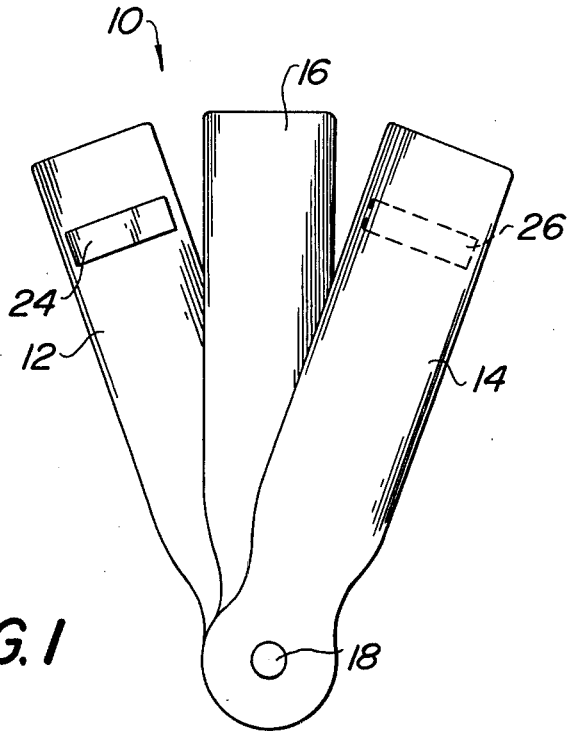
FIG. 1 is a plan view of the combined fan and noisemaker of the present invention.
Figure 2:
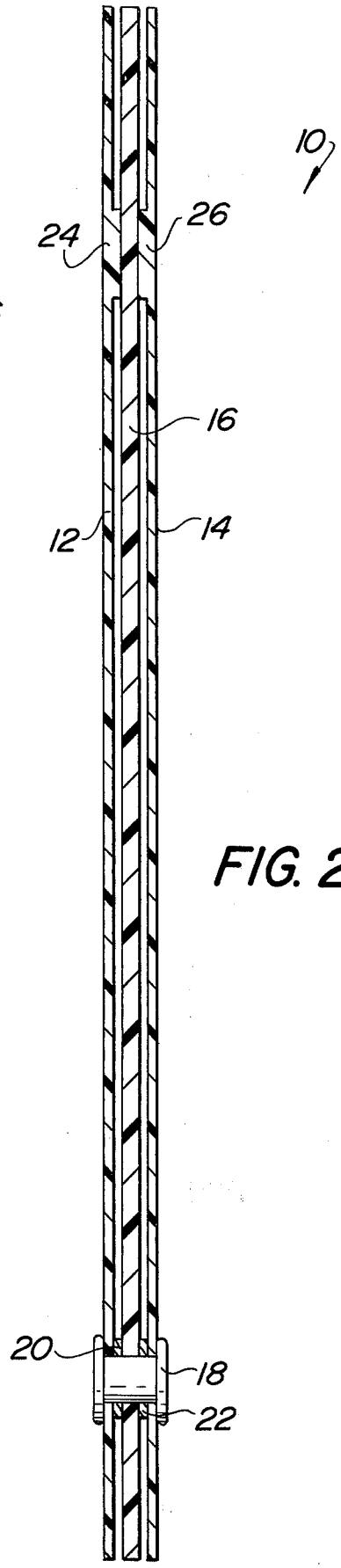
FIG. 2 is a longitudinal sectional view of the fan and noisemaker of the present invention.

The combined fan and noisemaker 10 comprises a pair of outer blades 12 and 14 and an intermediate anvil blade 16. The blades 12, 14 and 16 are joined together by the rivet 18, with the outer blade 12 being spaced from the anvil blade 16 by the spacer 20, and the outer blade 14 being spaced from the anvil blade 16 by the spacer 22.

The outer blades 12 and 14 may be formed of flexible plastic, such as polyethylene. A typical thickness for the outer blades would be on the order of 0.05 inches. The anvil blade is formed of a relatively rigid material, such as metal, or rigid plastic. It may have a thickness equal to 0.1 inch or thereabouts.

The outer blade 12 is provided with a protuberance 24 and the outer blade 14 is provided with a protuberance 26. These protuberances 24 and 26 are integral with the blades 12 and 14 and extend outwardly a distance which is preferably greater than the width of the spacers 20 and 22. The protuberances 24 and 26 face the juxtaposed faces of the anvil blade 16.

With outer blades having a length of approximately 1 foot and a maximum width of approximately two and a half inches, the protuberance may have a thickness of about 0.1 inch compared to a thickness of about 0.05 inch for the remainder of the outer blades. The protuberances may be positioned on the order of a half to one and a half inches below the outermost ends of the outer blades 12 and 14. Satisfactory protuberances may be in the form of circles, or rectangles. With blades of the aforesaid dimensions, the protuberances can have an area of on the order of two square inches.

The combined fan and noisemaker of the present invention may be used as a fan when the outer blades 12 and 14 are pivoted to either side of the anvil blade 16.

When the outer blades 12 and 14 are aligned juxtaposed to the anvil blade 16 the outer blades may be percussively struck onto the anvil blade. This may be accomplished by the user striking the combined fan and noisemaker 10 against his hand, leg, or against a chair or other object.

The heads of the rivet 18 should be flattened to the point where the blades remain in alignment when pivoted to a particular disposition.

The present invention may be embodied in other specific forms without departing from the spirit or essential attributes thereof and, accordingly, reference should be made to the appended claims, rather than to the foregoing specification as indicating the scope of the invention.

I claim:

1. A combined fan and noisemaker comprising a pair of outer blades, an anvil blade disposed intermediate said outer blades, each outer blade having a protuberance adjacent one of said outer blade's ends, which protuberance is juxtaposed to a face of said anvil blade when said outer blade is juxtaposedly aligned with said anvil blade, and means for pivotably securing together said outer and anvil blades at a point remote from said protuberances about an axis perpendicular to their major faces whereby said outer blades may be selectively pivoted to an open fan-like disposition, or may be aligned in juxtaposed relationship so that said outer blades may be percussively struck on said anvil blade.

2. A combined fan and noisemaker in accordance with claim 1 in which the outer blades are relatively flexible and the anvil blade is relatively rigid.

3. A combined fan and noisemaker in accordance with claim 1 in which the means for pivotably securing together said outer and anvil blades include a spacer intermediate each of said outer blades and the anvil blade.

* * * * *